US005702555A

United States Patent [19]

Caudal et al.

[11] Patent Number: 5,702,555

[45] Date of Patent: Dec. 30, 1997

[54] METHOD OF RELEASABLY SECURING THE END OF A ROLL OF MATERIAL

[75] Inventors: Pierre Caudal, Locmariaquer; Guy Mahe, Quimperle, both of France; Georgia Anna Baker, Troy; James Joseph Duis, Dayton, both of Ohio

[73] Assignee: Schweitzer-Mauduit International, Inc., Alpharetta, Ga.

[21] Appl. No.: 715,718

[22] Filed: Sep. 19, 1996

Related U.S. Application Data

[60] Continuation of Ser. No. 453,733, May 30, 1995, abandoned, which is a division of Ser. No. 123,834, Sep. 20, 1993, abandoned.

[51] Int. Cl.[6] ..... B32B 31/00

[52] U.S. Cl. ..... 156/247; 156/187; 156/215; 156/254; 156/289

[58] Field of Search ..... 156/149, 152, 156/159, 182, 184, 185, 187, 215, 230, 235, 247, 249, 254, 289, 361

[56] References Cited

U.S. PATENT DOCUMENTS

| | | | |
|---|---|---|---|
| Re. 32,249 | 9/1986 | Esmay | 428/40 |
| 2,205,956 | 6/1940 | Humphner | 40/638 |
| 2,889,038 | 6/1959 | Kalleberg | 206/59 |
| 3,001,689 | 9/1961 | Burton | 383/200 |
| 3,311,339 | 3/1967 | Frye | 248/205.3 |
| 3,394,799 | 7/1968 | Ritson et al. | 206/59 |
| 3,459,626 | 8/1969 | Morgan | 428/40 |
| 3,675,844 | 7/1972 | Sorrell | 229/80 |
| 3,690,909 | 9/1972 | Finley | 428/40 |
| 3,912,571 | 10/1975 | Hartbauer et al. | 156/351 |
| 3,960,272 | 6/1976 | Hartbauer et al. | 156/184 X |
| 4,022,248 | 5/1977 | Hepner | 156/215 X |
| 4,157,410 | 6/1979 | McClintock | 428/40 |
| 4,182,789 | 1/1980 | Castelluzzo | 428/40 |
| 4,243,453 | 1/1981 | McClintock | 156/215 X |
| 4,310,137 | 1/1982 | Frye | 248/467 |
| 4,317,555 | 3/1982 | Hogg | 248/467 |
| 4,379,012 | 4/1983 | Heymanns | 156/157 |
| 4,389,270 | 6/1983 | McClintock | 156/215 X |
| 4,581,083 | 4/1986 | Schutz et al. | 156/187 X |
| 4,608,288 | 8/1986 | Spindler | 428/78 |
| 4,746,556 | 5/1988 | Matsuguchi et al. | 428/40 |
| 5,141,789 | 8/1992 | Matsuzawa et al. | 428/40 |
| 5,356,496 | 10/1994 | Lincoln et al. | 156/361 X |

*Primary Examiner*—Melvyn Andrews
*Assistant Examiner*—Paul M. Rivard
*Attorney, Agent, or Firm*—Dority & Manning, P.A.

[57] ABSTRACT

A cleavable release structure composed of two release bases each having an outer surface and an inner surface; a release coating on the inner surface of each release base; a layer of a pressure sensitive adhesive adjacent the coating on the inner surface of each release base; and a clearable layer sandwiched between the pressure sensitive adhesive layers, so that the cleavable layer is adapted to cleave and separate when subjected to a peeling force greater than its internal bond strength and less than the adhesion force of the pressure sensitive adhesive. Each layer of pressure sensitive adhesive should be adapted to provide an adhesion force greater than about 24 ounces per inch of width. The release coating should be adapted to provide a release level of from about 1 to about 30 grams per centimeter of width. The clearable layer should have an internal bond strength of from about 2 to about 20 ounces per inch of width.

11 Claims, 2 Drawing Sheets

METHOD OF RELEASABLY SECURING THE END OF A ROLL OF MATERIAL

This is a continuation of application Ser. No. 08/453,733, filed May 30, 1995, which was abandoned upon the filing hereof, which is a division of Ser. No. 08/123,834, filed Sep. 20, 1993, now abandoned.

FIELD OF THE INVENTION

The field of the present invention is directed toward tapes for releasably sealing the tail end of a roll of material.

BACKGROUND OF THE INVENTION

Manufacturing processes that involve materials such as paper, film, foil, fabrics or the like often feed the material into the process from storage on reels, spools, rolls or the like. Reels, spools or rolls need to be changed when they run out of material. This is particularly evident in high speed manufacturing processes using such feed systems. Even if the amount of material stored on each reel, spool or roll is greatly increased, a stockpile of rolls must be maintained to ensure uninterrupted operation.

One problem with storing material on reels, spools or rolls is that, unless the material is self-adhesive, the tail end of the material will unravel. Various single-faced and double-faced adhesive tapes have been used to adhere the tail end of the material to the roll so that the roll may be transported, handled or put in operating position on a converting machine. However, detaching a tail end secured by such tapes may tear or otherwise damage sensitive materials such as, for example, fine papers, thin films, coated materials or the like. This could result in scrapping the last (i.e., outside) windings on the reel, spool or roll which could represent a meaningful amount of material, particularly if the diameter of the reel, spool or roll is large.

In some situations, adhesive tapes have been designed so that the adhesive releases the material to be secured when a peeling force is applied. For example, adhesives having different adhesion strengths can be applied to different sides of a double-faced tape so that the adhesive on one side remains attached while the adhesive on the other side releases when subjected to a peeling force. Once the tail end is detached, such an arrangement leaves a strip of exposed adhesive on one surface of the material. This can be unsatisfactory because the uncovered adhesive could foul up or jam some manufacturing processes.

Thus, there is still a need for an effective tape or release structure for releasably securing the tail end of a reel, spool or roll of material to the roll so that, upon subsequent detachment of the tail end from the roll, the tape generally centrally cleaves or splits so that very little, if any, damage occurs to the first winding on the roll and/or adhesive exposed on the surface of the roll of material.

OBJECTS OF THE INVENTION

Accordingly, it is a general object of the present invention to provide a tape for releasably securing the tail end of a roll of material to the roll so that, upon subsequent detachment of the tail end from the roll, the tape generally centrally cleaves or splits so that very little, if any, damage occurs to the first winding on the roll and/or adhesive is present on the surface of the roll of material.

Still further objects and the broad scope of applicability of the present invention will become apparent to those of skill in the art from the details given hereinafter. However, it should be understood that the detailed description of the presently preferred embodiment given herein of the present invention is given only by way of illustration because various changes and modifications well within the spirit and scope of the invention will become apparent to those of skill in the art in view of the detailed description.

DEFINITIONS

As used herein, the term "outer surface" refers to the face of a layer of a multi-layer material which is oriented toward or actually composes the exterior portion of the multi-layer material.

As used herein, the term "inner surface" refers to a layer which is not an outer surface.

As used herein, the term "roll" refers to an arrangement or configuration of a material or materials in a rolled form including, but not limited to, reels, spools, spindles, bobbins, wheels, cylinders and balls.

As used herein, the term "palindromic" refers to a multilayer configuration which is substantially symmetrical. Examples of palindromic materials would be materials having the following symmetrical layer configurations: (1) A/B/A; (2) A/B/B/A; (3) A/B/C/B/A etc. An example of a non-palindromic material would be a material having a layer configuration of A/B/C/A.

As used herein, the term "palindromic" tape refers to a multilayer tape configuration which is substantially symmetrical. Examples of palindromic tapes would be tapes having the following layer configurations: (1) A/B/A; (2) A/B/B/A; (3) A/B/C/B/A etc. An example of a non-palindromic tape layer configuration would be a tape having a layer configuration of A/B/C/A.

As used herein, the term "release level" refers to the force required to remove one release liner mounted on a Testing Machines Inc. release tester (Tag and Label Manufacturers Institute Release and Adhesion Tester). Unless otherwise specified herein, all samples are tested utilizing a Testing Machines Inc. release tester generally in accordance with the test procedure described in the Pressure Sensitive Tape Council Test Methods booklet, "Removal Force of Release Liners on Tapes at 180 Degrees". A sample release liner is composed of a release base and a release coating. Test samples are approximately 2 inches×10 inches (in.) with the 2 in. dimension in the cross-machine direction of the liner. The release liner of a mounted sample is removed from the adhesive to which it is adhered at an angle of about 180 degrees and a rate of about 300 inches per minute (in./min.). The results of testing (i.e., the release level) are reported in units of force per unit of width. For example, the release level can be reported in units of $grams_{force}$/centimeter or $ounces_{force}$/inch.

As used herein, the term "adhesion strength" refers to the relative level of bonding between two substances by surface attachment provided by an adherent. Unless otherwise specified herein, adhesion strength is measured generally in accordance with ASTM D 3330-90 (Test Method A—Single Coated Tapes) utilizing a 90 degree or "L" peel test on stainless steel. Each test sample is composed of a pressure sensitive adhesive coated tape. The adhesive surfaces are covered by a release liner. Samples are approximately 1 in.×5 in. One release liner is removed, and the exposed adhesive is laminated to a stainless steel panel utilizing a 4.5 lb. roller, rolled at 12 in./min. twice along the length of the test strip. Each sample has a dwell time of 10 minutes. One end of the test strip is put into the top jaw of an Instron Model 1132 Universal Test Instrument. The strip is pulled away from the panel at a 90 degree angle. The rate at which the Instron jaw traveled away from the panel is 12 inches per minute. The stainless steel panels are washed with toluene and rinsed with acetone between tests. The results of testing (i.e., the adhesion strength) are reported in units of force per unit of width. For example, the adhesion strength can be reported in units of $grams_{force}$/centimeter or $ounces_{force}$/inch.

As used herein, the term "internal bond strength" refers to the initial peak load per unit width required to produce separation of a discreet, relatively flat sample due to application of a peeling force. Generally speaking, internal bond strength is evaluated by a standard test for Peel Resistance of Adhesives (T-Peel Test). Unless otherwise specified herein, all samples are tested generally in accordance with ASTM D 1876-72 (Reapproved 1983). Testing is conducted immediately after samples are prepared. The test instrument is an Instron Model 1132 Universal Test Instrument. The Instron jaw is set to travel at a rate of 12 inches per minute. The results of testing (i.e., the internal bond strength) are reported in units of force per unit of width. For example, the internal bond strength can be reported in units of $grams_{force}$/centimeter or $ounces_{force}$/inch.

SUMMARY OF THE INVENTION

The present invention addresses the needs discussed above by providing a cleavable release structure composed of (1) two release bases each having an outer surface and an inner surface, (2) a release coating on the inner surface of each release base, (3) a layer of a pressure sensitive adhesive adjacent the coating on the inner surface of each release base, (4) a cleavable layer sandwiched between the pressure sensitive adhesive layers, so that the cleavable layer is adapted to cleave and separate when subjected to a peeling force greater than its internal bond strength and less than the adhesion force of the pressure sensitive adhesive.

In one aspect of the invention, the pressure sensitive adhesive layers are formed from pressure sensitive adhesives such as, for example, acrylics, synthetic rubber based materials or natural rubber based materials. If the pressure sensitive adhesive is an acrylic adhesive, it may be in the form of a tackified acrylic. Desirably, these pressure sensitive adhesives are water dispersable and/or repulpable. It is also desirable that each layer of pressure sensitive adhesive be adapted to provide an adhesion force greater than about 24 ounces per inch of width.

According to the present invention, the release bases may be one or more of kraft papers, super-calendered kraft papers, clay-coated kraft papers, polyolefin coated kraft papers, glassines, parchments and films. If the release base is a film, it may be one or more polyolefin films, polystyrene films and/or polyester films.

According to one aspect of the invention, the release coatings may be formed from any suitable release agent. Exemplary release agents include silicones, modified silicones, polyolefins, fluorocarbons, Werner-type chromium complexes, and polyvinyl octadecyl carbamate. The release coating should be adapted to provide a release level of from about 1 to about 30 grams per centimeter of width. For example, at least one of the release coatings should be adapted to provide a release level of from about 2 to about 15 grams per centimeter of width to ease removal of the release base by hand.

Generally speaking, the cleavable layer is selected from coated and uncoated papers made from sulphate pulp, sulphite pulp, groundwood pulp, thermo-mechanical pulp, semi-chemical pulp, mixtures of pulp and fillers (e.g., chalk, calcium carbonate and the like), and mixtures of pulp and other additives. The cleavable layer should have an internal bond strength of from about 2 to about 20 ounces per inch of width. For example, the internal bond strength of the cleavable layer may range from about 3 to about 10 ounces per inch of width. According to one aspect of the present invention, the cleavable layer may be a paper sheet containing an effective amount of a filler such as, for example, chalk to lower the internal bond strength (i.e., internal cohesion) of the paper. For example, the clearable layer may be a paper sheet containing up to about 40 percent, by weight, of a filler to lower the internal bond strength of the paper. As another example, the clearable layer may be a paper sheet containing from about 20 to about 35 percent, by weight, filler.

According to one aspect of the present invention the cleavable layer may have a thickness of from about 1 to about 20 mils. For example, the cleavable layer may have a thickness of from about 2 to about 15 mils. Desirably, the cleavable layer may have a thickness of from about 4 to about 10 mils.

In another aspect of the present invention, the cleavable release structure may include a varnish layer located between at least one of the pressure sensitive adhesive layers and its respective interior release coating along an edge portion of the structure to ease removal of the release base by hand. Desirably, this varnish layer has a width of less than about one-half inch. For example, this varnish layer has a width of from about 1/16th to about 1/4th inch.

In yet another aspect of the present invention, at least one of the pressure sensitive adhesive layers has a width which is less than the width of the cleavable layer so that an edge portion of the cleavable layer is devoid of pressure sensitive adhesive in that pressure sensitive adhesive layer to ease removal of the release base by hand. Desirably, the edge portion which is devoid of pressure sensitive adhesive has a width of less than about one-half inch. For example, the edge portion which is devoid of pressure sensitive adhesive has a width of from about 1/16th to about 1/4th inch.

In still another aspect of the present invention, at least one edge of at least one of the release bases extends from about 1/16th to about 1/4th inch beyond the edge of the cleavable layer for ease of removal of the release base. Desirably, at least one edge of at least one of the release bases extends about 1/8th inch beyond the edge of the cleavable layer.

According to the present invention, the cleavable release structure may be in the form of a cleavable tape adapted to releasably secure the tail of a roll of material. Desirably, the cleavable release structure may be in the form of a cleavable, palindromic tape adapted to releasably secure the tail of a roll of material. Accordingly, the present invention encompasses a method of releasably securing the end of a roll of material to the roll by utilizing a cleavable release structure composed of a first layer and second layer of a pressure sensitive adhesive; and a cleavable layer sandwiched between the pressure sensitive adhesive layers, so that the cleavable layer is adapted to cleave and separate when subjected to a peeling force greater than its internal bond strength and less than the adhesion force of the pressure sensitive adhesive.

DETAILED DESCRIPTION OF THE INVENTION

Figure 1:
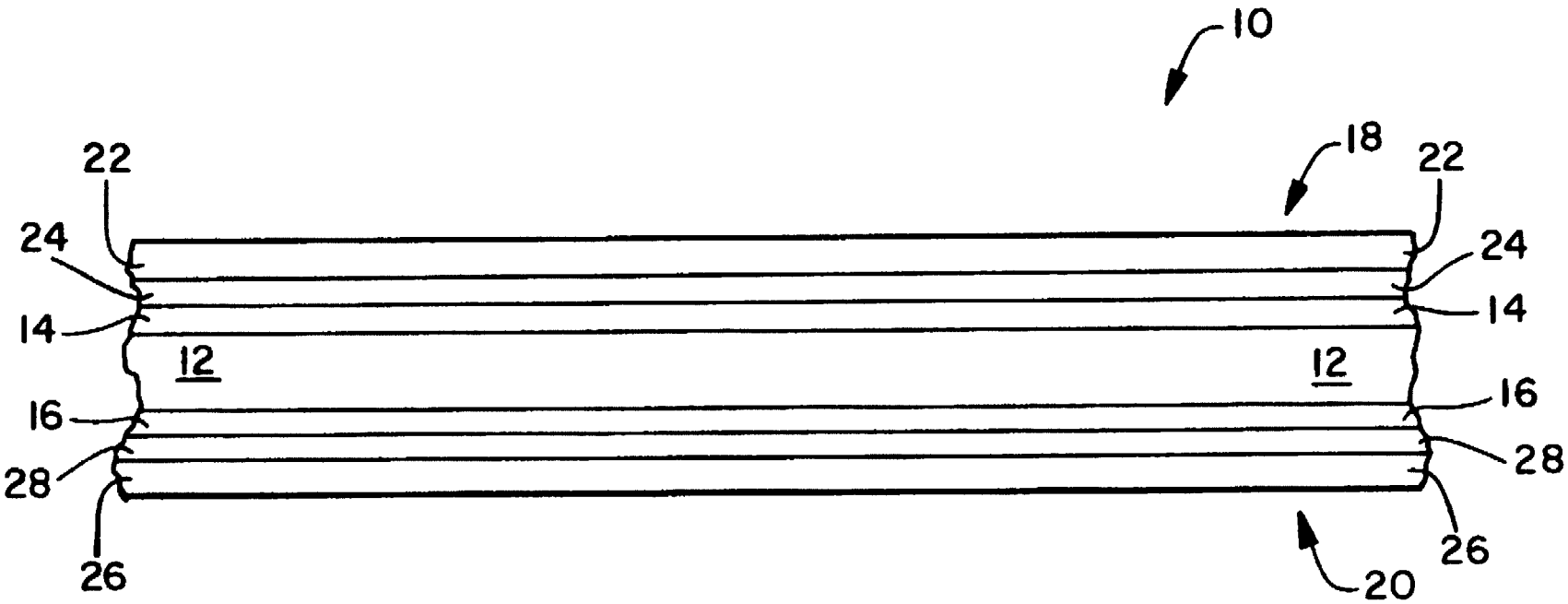
FIG. 1 is an illustration of an exemplary cleavable release structure.

Referring to FIG. 1 of the drawings there is illustrated at 10 an exemplary cleavable release structure. Generally speaking, the cleavable release structure 10 is composed of a cleavable paper 12, pressure sensitive adhesive coatings 14 and 16 on each side of the cleavable paper 12, and release liners 18 and 20 covering the adhesives on both sides. The first release liner 18 is composed of a release base 22 and a release coating 24. The other release liner 20 is also composed of a release base 26 and a release coating 28.

Figure 2:
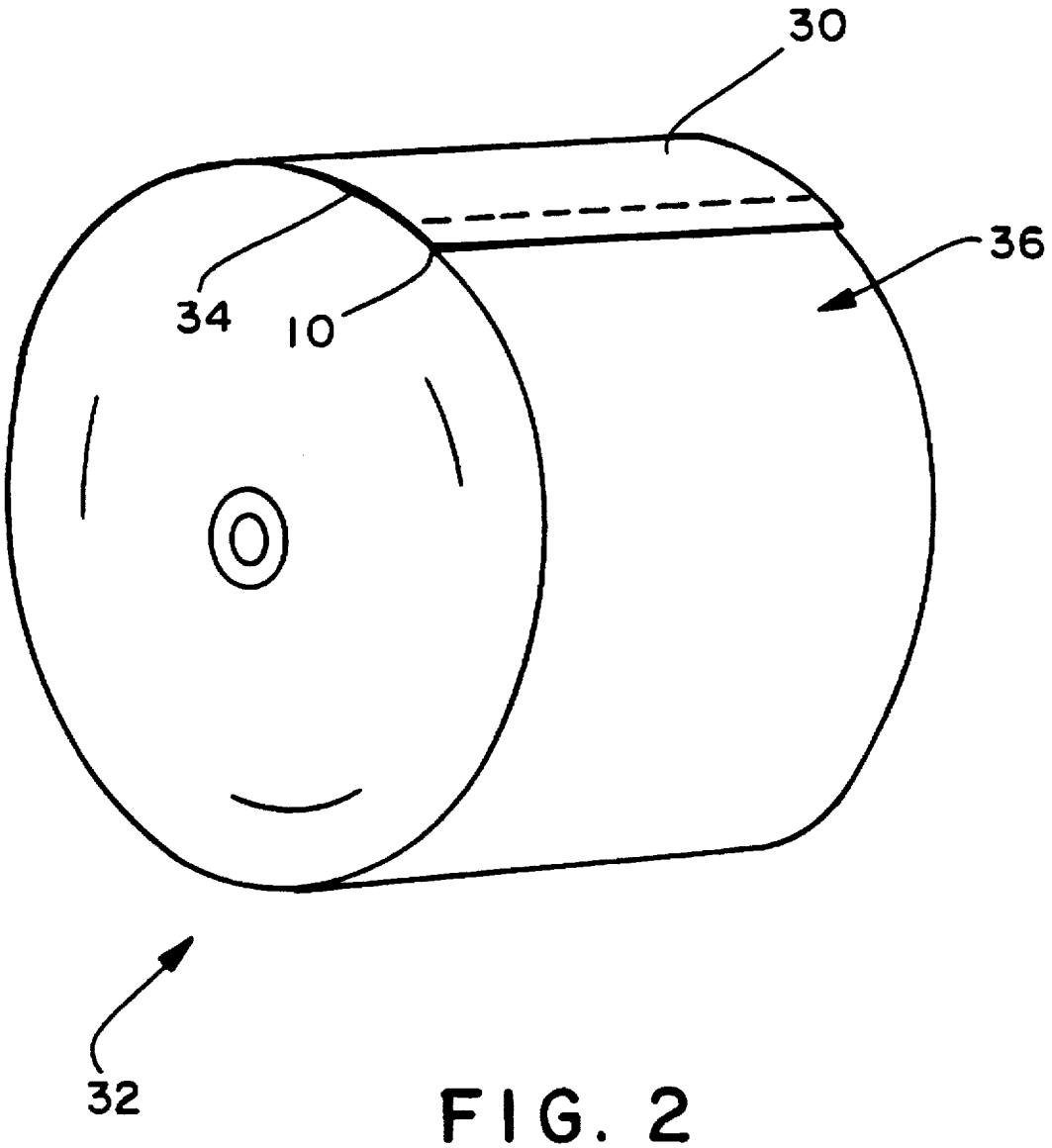
FIG. 2 is an illustration of an exemplary application of a cleavable release structure.

FIG. 2 of the drawings illustrates an exemplary use of the clearable release structure 10 as a tape adapted to releasably secure the tail 30 of a roll of material 32. The cleavable release structure 10, with the release bases removed, adheres the bottom surface 34 of the tail 30 to the top surface 36 of the roll of material 32.

Referring to FIGS. 1 and 2 of the drawings, when applied to releasably secure the tail end of a roll of material to the roll, the cleavable release structure 10 is essentially composed of a first layer and second layer of a pressure sensitive adhesive (i.e., layers 14 and 16, respectively); and a cleavable layer 12 sandwiched between the pressure sensitive adhesive layers 14 and 16. The pressure sensitive adhesive layers 14 and 16 adhere to the bottom surface 34 of the tail 30 to the top surface 36 of the roll of material 32. During use, the clearable layer 12 is adapted to cleave and separate when subjected to a peeling force greater than its internal bond strength and less than the adhesion force of the pressure sensitive adhesive.

The cleavable paper 12 component of the release structure 10 may be a coated or uncoated paper made from mechanical or chemical pulps. Suitable cleavable paper 12 may be made from pulps such as, for example, sulphate pulp, sulphite pulp, groundwood pulp, thermo-mechanical pulp, or semi-chemical pulp. Desirably, the paper is made from a sulphate pulp. Exemplary cleavable papers include an 8.0 mil CIS Tag available from Federal Paper Board, Augusta, Ga.; an 50 LB (pound) Premium EDP available from James River Corporation, Southhampton, Pa.; a 10 mil C2S Green Tag available from Riverside Paper, CBC Coating Division, Appleton, Wis.; and a 35 gsm (grams per square meter) cigarette paper containing 35%, by weight, calcium carbonate filler, available from Papeteries de Mauduit S. A., Quimperle, France.

The cleavable paper may be a paper formed from mixtures of pulp and other additives (e.g., chalks, fillers or debonders) which may affect the internal bond strength of the paper. The additives can be added to the pulp slurry. It is contemplated that two or more discrete pulp layers may be joined to form a single sheet. Alternatively, a single layer of pulp may be folded to provide a single sheet composed of two layers. Additives may be deposited between the pulp layers so that a structure is formed having a paper sheet exterior sandwiching the additives. If additives are used, they may be added in sufficient amount to provide the desired internal bond strength. For example, the clearable layer may be a paper sheet containing up to about 40 percent, by weight, of a filler such as, for example, chalk, calcium carbonate, china clay or the like to lower the internal bond strength (i.e., internal cohesion) of the paper. Desirably, the cleavable layer may be a paper sheet containing from about 20 to about 35 percent, by weight, filler. For example, the cleavable layer may be a paper sheet having a basis weight of about 35 gsm (e.g., a cigarette paper having a basis weight of about 35 grams per square meter) and which contains about 35 percent, by weight calcium carbonate filler. In one aspect of the present invention, the cleavable layer may be a paper sheet coated on one side with about 10 to about 15 percent, by weight, filler. Desirably, such a coated paper sheet is a 180 gsm paper sheet coated on one side with about 13 percent, by weight, China clay filler.

The cleavable paper 12 component of the release structure 10 is made utilizing conventional paper-making techniques and/or methods known in the art. The cleavable paper is adapted to cleave and separate when subjected to a peeling force. One useful measure of a paper's ability to cleave and separate is its internal bond strength. Generally speaking, internal bond strength is evaluated by a standard test for Peel Resistance of Adhesives (T-Peel Test) such as, for example, ASTM D 1876-72 (Reapproved 1983). It has been found that cleavable papers suitable for use in the release structure of the present invention exhibit an internal bond strength of 20 oz./in. width or less (ounces per inch of width). It should be understood that cleavable papers having an internal bond strength greater than 20 oz./in. width may be used in applications where greater strength is needed. However, such high internal bond strengths may make it difficult for the paper to cleave. Desirably, the cleavable paper has an internal bond strength from about 2 to about 10 oz./in. width. More desirably, the cleavable paper has an internal bond strength from about 3 to about 9 oz./in. width.

When the cleavable paper splits or separates, sufficient paper mass must remain on each side of the split to cover the adhesives on either side of the cleavable paper. Generally speaking, papers which exhibit this ability to cover the adhesives after separation have a thickness of 1 to about 20 mils. Desirably, the thickness ranges from about 2 to about 20 mils. More desirably, the thickness ranges from about 2 to about 15 mils. Even more desirably, the thickness ranges from about 2 to about 10 mils. Papers having a thickness much greater than 20 mils (e.g., 50 mils or even greater) may be used in applications where greater thickness or masking ability is needed.

In some applications of the cleavable release structure, it may be useful to visually locate the pieces of the structure after use. For example, when the cleavable release structure is used as a tape and the material on which the tape is adhered is to be repulped, it may be desirable to prevent the tape from being introduced into the repulp stream. In such cases, it may be advantageous to have a colorant/dye applied to the paper. Conventional colorants or dyes may be used. Desirably, the colorant/dye will have only a minimal impact on the internal bond strength of the cleavable paper. The colorant/dye may be applied by any technique known in the art. Such techniques include, but are not limited to, air knife or knife over roll coating, printing methods such as, for example, gravure or flexography, spray methods, dip methods and the like.

The pressure sensitive adhesive coatings 14 and 16 on each side of the cleavable paper 12 can be made from any suitable pressure sensitive adhesive. Generally speaking, the adhesive is selected so that it exhibits an adhesion strength greater than the internal bond strength of the cleavable paper 12. It has been found that the adhesive should exhibit an adhesion strength which is generally at least about 20 percent greater than the strength of the cleavable paper (i.e., 120 percent of the internal bond strength). Desirably, the adhesion strength may be from about 20 percent to 50 percent (or more) greater than the strength of the cleavable paper (i.e., from about 120 to 150 percent or more of the internal bond strength). For example, if the cleavable paper exhibits an internal bond strength of 20 oz./in. width (as determined generally in accordance with ASTM D 1876-72 (Reapproved 1983)), a useful adhesive may have an adhesion strength of 24 oz./in. or more (as determined generally in accordance with ASTM D 3330-90 (Test Method A—Single Coated Tapes) utilizing a 90 degree or "L" peel test on stainless steel).

In order to achieve satisfactory performance, the same adhesive or different adhesives may be applied to opposite sides of the cleavable paper. Exemplary adhesive materials include, but are not limited to, acrylic adhesives, tackified acrylic adhesives, natural rubber-based adhesives, synthetic rubber-based adhesives, and multipolymers containing poly (ethylene-vinyl acetate) maleate. In some cases, it may be desirable for the adhesive to have dispersibility characteristics which make it compatible with paper repulp systems.

The adhesives may be applied to each side of the cleavable paper by any method known in the art. Useful methods include direct coating (i.e., the application of the adhesive directly to the cleavable paper 12), and transfer coating (i.e., the application of the adhesive to the release liners 18 and 20 and the subsequent lamination of the adhesive/release liners 18 and 20 to the cleavable paper 12).

According to the present invention, the cleavable release structure may include a varnish layer located between at least one of the pressure sensitive adhesive layers and its respective interior release coating along an edge portion of the structure to ease removal of the release base by hand. Desirably, this varnish layer may have a width of less than about one-half inch. For example, this varnish layer has a width of from about 1/16th to about 1/4th inch.

Alternatively and/or additionally, at least one of the pressure sensitive adhesive layers may have a width which is less than the width of the cleavable layer so that an edge portion of the cleavable layer is devoid of pressure sensitive adhesive in that pressure sensitive adhesive layer to ease removal of the release base by hand. The edge portion which is devoid of pressure sensitive adhesive may have a width of less than about one-half inch. For example, the edge portion which is devoid of pressure sensitive adhesive has a width of from about 1/16th to about 1/4th inch.

Each release liner 18 and 20 is composed of a release base (22 and 26, respectively) and a release coating (24 and 28, respectively). The release base can be any paper or film commonly used for such purpose. Exemplary materials include, kraft paper, super-calendered kraft paper, clay-coated bleached kraft paper, glassine, parchment, polyester films, polystyrene films, polyolefin films (e.g., polyethylene or polypropylene films) and papers coated with a film such as a polyolefin, polyester or polystyrene film. In many applications, super-calendered kraft paper has been found to work well as the release base.

It is contemplated that at least one edge of at least one of the release bases may extend from about 1/16th to about 1/4th inch beyond the edge of the cleavable layer for ease of removal of the release base. Desirably, at least one edge of at least one of the release bases extends about 1/8th inch beyond the edge of the cleavable layer.

The release coating can be any suitable material commonly used for that purpose. Exemplary release coatings include silicones, modified silicones, fluorocarbons, polyethylenes, Werner-type chrome complexes, and polyvinyl octadecylcarbamate. Desirably, the release coating is made from a silicone-type material.

The release coating can be applied to both sides of the release base, but is desirably applied to only one side. The release coating is selected to provide ease of removal of the release liner away from the pressure sensitive adhesive. Generally speaking, the adhesive is selected so that it exhibits an adhesion strength (as determined generally in accordance with ASTM D 3330-90 (Test Method A—Single Coated Tapes) utilizing a 90 degree or "L" peel test on stainless steel) greater than the internal bond strength of the clearable paper 12 (as determined generally in accordance with ASTM D 1876-72 (Reapproved 1983)). It has been found that the release coating should provide a release level (i.e., the adhesion between the release liner and the adhesive as determined utilizing a Testing Machines Inc. release tester generally in accordance with the test procedure described in the Pressure Sensitive Tape Council Test Methods booklet, "Removal Force of Release Liners on Tapes at 180 Degrees") which is generally less than the internal bond strength of the cleavable paper (as determined generally in accordance with ASTM D 1876-72 (Reapproved 1983)). For example, satisfactory release coatings may provide a release level that is at least about 20 percent lower than the strength of the cleavable paper (i.e., 80 percent of the internal bond strength). Desirably, the release level may be from about 20 percent to 50 percent lower than the strength of the cleavable paper (i.e., from less than about 50 percent up to about 80 percent of the internal bond strength of the cleavable paper). For example, if the cleavable paper exhibits an internal bond strength of about 20 oz./in. width, a useful release coating may have a release level of about 1 gram per centimeter of tape width.

EXAMPLES

Cleavable release structures were constructed from release liners, adhesives and cleavable papers. Papers were evaluated for suitability as the cleavable middle layer of the release structures.

Release Liner

A silicone coated release liner was made by coating a one-hundred percent (100%) solids silicone onto a nominal 40 lb./3000 sq. ft. (pounds per square feet) super-calendered Kraft (release base) via an offset gravure coater at 0.7 lb./3000 sq. ft. and thermally curing to coating in an oven. The formulation of the silicone was selected to provide the desired release level (i.e., force required to peel the liner away from the adhesive). The formulation selected for use in the following examples was 100 parts General Electric 4300 vinyl reactive platinum catalyzed silicone base polymer with 4.5 parts General Electric 4305 silicone cross-linker.

Pressure Sensitive Adhesive

A one-hundred percent (100%) solids rubber-based pressure sensitive adhesive was coated onto the release base by hot-melt slot die coating at 14.0 lb./3300 sq. ft. The adhesive selected for use was National Starch 34-4134. A second 40 lb. release liner made in the same way as above was laminated to the adhesive coating, creating an adhesive layer supported between two release liners. A sample of this construction was cut to about 8.5×11 inches.

Cleavable Release Structure

One of the release liners was peeled away, and a paper to be tested as the cleavable middle layer was laminated to the exposed adhesive. One release liner from another piece of the construction described above was removed and the adhesive laminated to the opposite side of the paper, creating a test sample composed of a 40 lb. release liner/adhesive/ cleavable paper/adhesive/40 lb. release liner. Particular cleavable papers and paper suppliers are listed in Table I.

Cleave/Separation Testing

A portion of the test sample was cut to 1 in.×1 in. and the suitability of the middle layer was tested by removing the release liners and bonding the adhesives with hand pressure between the first and second layers of a 6 in. wide roll of Champion 60 lb. Kromekote. The cross-machine direction of the cleavable layer of the test sample was placed along the machine-direction axis of the roll of 60 lb. Kromekote, so that when the end of the roll of 60 lb. Kromekote was pulled by hand the cleavable layer would split in its cross-direction. If the layer split cleanly and consistently and covered the pressure sensitive adhesives with paper fiber, the layer was considered suitable.

Internal Bond Strength

A portion of the test sample was cut to 1 in.×5 in. with the 1 in. dimension in the cross-web direction, and the cleavable layer was tested for internal bond strength. A strip of 60 lb. Kromekote was laminated to each side and the force required to initiate cleaving was measured and reported as the internal bond strength. The force required to initiate cleaving was measured generally in accordance with ASTM D 1876-72 (Reapproved 1983)—a standard test for Peel Resistance of Adhesives (T-Peel Test). Testing was conducted immediately after samples were prepared. The test instrument was an Instron Model 1132 Universal Test Instrument. The Instron jaw was set to travel at a rate of 12 inches per minute.

Adhesion Strength

The adhesion strength was measured generally in accordance with ASTM D 3330-90 (Test Method A—Single Coated Tapes) utilizing a 90 degree or "L" peel test on stainless steel. Each test sample was composed of a pressure sensitive adhesive coated tape. The adhesive surfaces were covered by a release liner. Samples measured 1 in.×5 in. One release liner was removed, and the exposed adhesive laminated to a stainless steel panel utilizing a 4.5 lb. roller, rolled at 12 in./min. twice along the length of the test strip. Each sample had a dwell time of 10 minutes. One end of the test strip was put into the top jaw of an Instron Model 1132 Universal Test Instrument. The strip was pulled away from the panel at a 90 degree angle. The rate at which the Instron jaw traveled away from the panel was 12 inches per minute. The stainless steel panels were washed with toluene and rinsed with acetone between tests.

Release Level

Sample release liners were composed of a release base and a release coating. Samples measuring 2 inches×10 inches (the 2 inch dimension running in the cross-machine direction) were mounted on a Testing Machines Inc. release tester (Tag and Label Manufacturers Institute Release and Adhesion Tester). The samples were tested essentially in accordance with the test procedure described in the Pressure Sensitive Tape Council Test Methods booklet, "Removal Force of Release Liners on Tapes at 180 Degrees". Mounted samples were removed from the release tester at a 180 degree angle at a rate of 300 inches per minute.

Test Results

Not all papers tested were found to be suitable for use. Only those exhibiting an internal bond strength as evaluated by T-Peel test of less than 20 oz./in. width were found to perform acceptably in the suitability test. Papers with an internal bond strength of less than 2 oz./in. width are believed to be too easily separated for good performance. The results of testing is given in Table I.

TABLE I

| Example No./ Cleavable Paper/ Supplier | Suitability Test Result | T-Peel (oz./in.) | Release Force (gms./cm.) | Peel Adhesion (oz./in.) |
|---|---|---|---|---|
| 1. 8 mil CIS Tag, Federal Paper Board Augusta, Georgia | OK | 9 | 3.5 | 67 |
| 2. 50 LB Premium EDP, James River Corporation Southampton, Pennsylvania | Not OK | 22 | 2.4 | 56 |
| 3. 10 mil C2S Green Tag Riverside Paper, CBC Coating Division Appleton, Wisconsin | OK | 10 | 1.0 | 50 |
| 4. 35 gsm cigarette paper containing 35%, by weight, calcium carbonate filler, Papeteries de Mauduit S. A. Quimperle, France | OK | 10 | 2.4 | 52 |

It should be understood that the detailed description and specific examples which indicate the presently preferred embodiments of the invention are given by way of illustration only since various changes and modifications within the spirit and scope of the appended claims will become apparent to those of ordinary skill in the art upon review of the above detailed description.

What is claimed is:

1. A method for releasably securing the end of a roll of material to the roll, comprising:

winding the material around a longitudinal axis of the roll until the end of the material is adjacent an outermost winding of the material on the roll;

disposing a cleavable adhesive tape between opposing surfaces of the end of the material and the outermost winding, the cleavable adhesive tape including a cleavable layer having a first side and a second side, said first side being coated with a first pressure sensitive adhesive layer and said second side being coated with a second pressure sensitive adhesive layer;

pressing the end of the material against the roll so that the adhesive layers of the cleavable adhesive tape adhere to the end of the material and the outermost winding respectively; and releasing the end of the material by pulling the end of the material away from the outermost winding causing the cleavable adhesive tape to cleave along the cleavable layer, said cleavable layer having a thickness such that, when said cleavable layer is cleaved, a sufficient amount of said cleavable layer remains on said first pressure sensitive adhesive and said second pressure sensitive adhesive to cover each of said adhesive layers.

2. A method as defined in claim 1, wherein said cleavable layer comprises a material selected from the group consisting of coated and uncoated papers made from sulphate pulp, sulphite pulp, groundwood pulp, thermo-mechanical pulp and semi-chemical pulp.

3. A method as defined in claim 1, wherein said cleavable layer has a thickness from about 1 mil to about 20 mils.

4. A method as defined in claim 1, wherein said cleavable layer has a thickness greater than 20 mils.

5. A method as defined in claim 1, wherein said cleavable layer comprises a paper sheet containing up to about 40 percent by weight filler.

6. A method as defined in claim 5, wherein said paper sheet contains between about 20 percent filler to about 35 percent filler by weight.

7. A method as defined in claim 5, wherein said paper sheet has a basis weight of about 35 gsm.

8. A method as defined in claim 5, wherein said paper sheet comprises two pulp layers, said filler being deposited between said pulp layers.

9. A method as defined in claim 1, wherein said cleavable layer comprises a paper sheet coated on one side with a filler, said filler being added in an amount from about 10 percent to about 15 percent by weight of said paper sheet.

10. A method as defined in claim 9, wherein said paper sheet has a basis weight of 180 gsm.

11. A method as defined in claim 5, wherein said filler comprises a material selected from the group consisting of chalk, calcium carbonate, china clay, and mixtures thereof.

* * * * *